US011749075B2

(12) United States Patent
Jin et al.

(10) Patent No.: US 11,749,075 B2
(45) Date of Patent: Sep. 5, 2023

(54) TELEHAPTIC DEVICE

(71) Applicant: ELECTRONICS AND TELECOMMUNICATIONS RESEARCH INSTITUTE, Daejeon (KR)

(72) Inventors: Hanbit Jin, Daejeon (KR); Yun-Jeong Kim, Daejeon (KR); Hye Jin Kim, Daejeon (KR); Wooseup Youm, Daejeon (KR); Chan-Hwa Hong, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 17/513,543

(22) Filed: Oct. 28, 2021

(65) Prior Publication Data

US 2022/0327897 A1 Oct. 13, 2022

(30) Foreign Application Priority Data

Apr. 7, 2021 (KR) ..... 10-2021-0045377
Jul. 29, 2021 (KR) ..... 10-2021-0100006

(51) Int. Cl.
*G08B 6/00* (2006.01)
*B06B 1/06* (2006.01)

(52) U.S. Cl.
CPC ..... *G08B 6/00* (2013.01); *B06B 1/0629* (2013.01)

(58) Field of Classification Search
CPC ..... G08B 6/00; B06B 1/0629
See application file for complete search history.

(56) References Cited

U.S. PATENT DOCUMENTS 9,488,538 B2 * 11/2016 Thillainadarajah ..... G01L 1/26
9,594,444 B2 3/2017 Bae et al.
(Continued)

FOREIGN PATENT DOCUMENTS

JP 2010149290 A * 7/2010
KR 20110118584 A * 4/2011
(Continued)

OTHER PUBLICATIONS

Berg et al., IEEE Challenges in haptic communications over the tactile Internet, vol. 5, Nov. 2017.*
(Continued)

*Primary Examiner* — Quan Zhen Wang
*Assistant Examiner* — Mancil Littlejohn, Jr.
(74) *Attorney, Agent, or Firm* — LRK PATENT LAW FIRM

(57) ABSTRACT

Provided is a telehaptic device which includes a piezoelectric sensor module and a piezoelectric actuator module that are spaced apart from each other, wherein the piezoelectric sensor module includes a first flexible substrate, a first support substrate connected to the first flexible substrate, a piezoelectric sensor array on the first flexible substrate, and a first wireless communication circuit on the first support substrate, the piezoelectric actuator module includes a second flexible substrate, a second support substrate connected to the second flexible substrate, a piezoelectric actuator array on the second flexible substrate, and a second wireless communication circuit on the second support substrate, the piezoelectric sensor array includes piezoelectric sensors, the piezoelectric sensors being spaced apart according to a first pitch, the piezoelectric actuator array includes piezoelectric actuators, the piezoelectric actuators being spaced apart according to a second pitch, the first pitch and the second pitch are the same.

13 Claims, 9 Drawing Sheets

(56) References Cited

U.S. PATENT DOCUMENTS

| | | | | |
|---|---|---|---|---|
| 10,115,274 | B1 * | 10/2018 | Mandeville | H01Q 1/38 |
| 11,030,865 | B1 * | 6/2021 | Di Luca | G08B 6/00 |
| 2010/0239133 | A1 | 9/2010 | Schmitt et al. | |
| 2011/0032088 | A1 | 2/2011 | Kim et al. | |
| 2011/0221694 | A1 | 9/2011 | Karaoguz et al. | |

FOREIGN PATENT DOCUMENTS

| | | | | | |
|---|---|---|---|---|---|
| KR | 20170097230 | A | * | 12/2012 | |
| KR | 10-2013-0057200 | A | | 5/2013 | |
| WO | WO-2016040256 | A1 | * | 3/2016 | A61B 5/0053 |

OTHER PUBLICATIONS

Tae-Heon Yang et al., "Recent Advances and Opportunities of Active Materials for Haptic Technologies in Virtual and Augmented Reality", Advancedfunctional Materials, Mar. 2021.

* cited by examiner

TELEHAPTIC DEVICE

CROSS-REFERENCE TO RELATED APPLICATIONS

This U.S. non-provisional patent application claims priority under 35 U.S.C. § 119 of Korean Patent Application Nos. 10-2021-0045377, filed on Apr. 7, 2021, and 10-2021-0100006, filed on Jul. 29, 2021, the entire contents of which are hereby incorporated by reference.

BACKGROUND

1. Field of the Invention

The present disclosure herein relates to a telehaptic device.

2. Description of Related Art

Electronic device manufacturers try to create rich interfaces for users. Conventional electronic devices often provide visual and/or audible feedback to convey information to users. In some cases, in order to enhance the user experience, users may also be provided with kinesthetic feedback (such as active and resistive feedback) and/or tactile feedback (such as vibration, texture, and heat). In general, kinesthetic feedback and tactile feedback are collectively known as "haptic feedback" or "haptic effect". Haptic feedback may be useful to provide clues to warn the user about a particular event, or to provide a real feedback sensation that evokes a greater sensory experience. Haptic feedback may be used with conventional electronic devices and also with devices used to create simulated or virtual environments.

Various haptic actuation techniques have been used in the past to provide vibrotactile haptic feedback to touch sensitive devices such as touch screens.

SUMMARY

The present disclosure provides a telehaptic device that includes a piezoelectric sensor module that acquires tactile information with high resolution and wirelessly transmits the tactile information; and an actuator module that reproduces the tactile information in high resolution after receiving the tactile information in real time.

An embodiment of the inventive concept provides a telehaptic device including a piezoelectric sensor module and a piezoelectric actuator module that are separated and spaced apart from each other, wherein the piezoelectric sensor module includes: a first flexible substrate; a first support substrate connected to the first flexible substrate; a piezoelectric sensor array on the first flexible substrate; and a first wireless communication circuit on the first support substrate, wherein the piezoelectric actuator module includes: a second flexible substrate; a second support substrate connected to the second flexible substrate; a piezoelectric actuator array on the second flexible substrate; and a second wireless communication circuit on the second support substrate, wherein the piezoelectric sensor array includes a plurality of piezoelectric sensors, the piezoelectric sensors being arranged to be spaced apart according to a first pitch, wherein the piezoelectric actuator array includes a plurality of piezoelectric actuators, the piezoelectric actuators being arranged to be spaced apart according to a second pitch, wherein the first pitch and the second pitch are the same.

In an embodiment, the number of piezoelectric sensors may be equal to the number of piezoelectric actuators.

In an embodiment, the first pitch and the second pitch may be greater than 0.5 mm and within 2 mm.

In an embodiment, each of the piezoelectric sensors may include a first electrode, a second electrode and a piezoelectric polymer layer therebetween, wherein each of the piezoelectric actuators may include a third electrode, a fourth electrode and a piezoelectric ceramic layer therebetween.

In an embodiment, the first flexible substrate may include a first region in which the piezoelectric sensor array is provided and a second region connecting the first region and the first support substrate, wherein the second flexible substrate may include a third region in which the piezoelectric actuator array is provided and a fourth region connecting the third region and the second support substrate, wherein first metal wires may be further provided in the second region and second metal wires may be further provided in the fourth region In an embodiment, the first metal wires may include first signal wires and second signal wires, wherein each of the first signal wires may be electrically connected to a first electrode, wherein each of the second signal wires may be electrically connected to a second electrode, wherein the second metal wires may include third signal wires and fourth signal wires, wherein each of the third signal wires may be electrically connected to a third electrode, wherein each of the fourth signal wires may be electrically connected to a fourth electrode.

In an embodiment, an arrangement form of the piezoelectric sensors and an arrangement form of the piezoelectric actuators may be the same.

In an embodiment, the piezoelectric sensors and the piezoelectric actuators may be arranged in a zigzag form along a first direction parallel to the first flexible substrate.

In an embodiment, the piezoelectric sensor module may further include a piezo-resistive sensor array provided on the first flexible substrate, wherein the piezo-resistive sensor array may include a plurality of piezo-resistive sensors, wherein the piezo-resistive sensors may be provided between the piezoelectric sensors, respectively.

In an embodiment, each of the piezo-resistive sensors may include: a first electrode and a second electrode spaced apart along the first direction; and a conductive structure provided on the first electrode and the second electrode, a resistance of which varies according to pressure.

In an embodiment of the inventive concept, a telehaptic device includes a piezoelectric sensor module configured to be worn by a first user and a piezoelectric actuator module configured to be worn by a second user, wherein the piezoelectric sensor module may include: a first substrate; and a piezoelectric sensor array, a first driving circuit, and a transmitter on the first substrate, wherein the piezoelectric actuator module may include: a second substrate; and a piezoelectric actuator array, a second drive circuit, and a receiver on the second substrate, wherein the piezoelectric sensor array includes a first piezoelectric sensor and a second piezoelectric sensor, wherein the piezoelectric actuator array includes a first piezoelectric actuator and a second piezoelectric actuator, wherein the first piezoelectric sensor is configured to sense a first pressure and generate a first electrical signal, wherein the second piezoelectric sensor is configured to sense a second pressure and generate a second electrical signal, wherein the transmitter is configured to deliver first and second electrical signals to the receiver, wherein the second driving circuit is configured to generate a third electrical signal corresponding to the first electrical signal, and to generate a fourth electrical signal corresponding to the second electrical signal, wherein the first piezoelectric actuator is configured to generate a first vibration corresponding to the first pressure based on the third electrical signal, wherein the second piezoelectric actuator is configured to generate a second vibration corresponding to the second pressure based on the fourth electrical signal.

In an embodiment, a frequency of the first electrical signal may be the same as a frequency of the third electrical signal, wherein a frequency of the second electrical signal may be the same as a frequency of the fourth electrical signal.

In an embodiment, an amplitude of the first electrical signal may be greater than an amplitude of the second electrical signal, wherein an amplitude of the third electrical signal may be greater than an amplitude of the fourth electrical signal.

BRIEF DESCRIPTION OF THE DRAWINGS

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

In order to fully understand the configuration and effects of the inventive concept, preferred embodiments of the inventive concept will be described in detail with reference to the accompanying drawings. The inventive concept is not limited to the embodiments disclosed below, but may be implemented in various forms, and various modifications and changes may be added. However, it is provided to completely disclose the technical idea of the inventive concept through the description of the present embodiments, and to fully inform a person of ordinary skill in the art to which the inventive concept belongs. In the accompanying drawings, the components are shown to be enlarged in size for convenience of description, and the ratio of each component may be exaggerated or reduced.

In addition, terms used in the present specification may be interpreted as meanings commonly known to those of ordinary skill in the art, unless otherwise defined. Hereinafter, the inventive concept will be described in detail by describing embodiments of the inventive concept with reference to the accompanying drawings.

Figure 1:
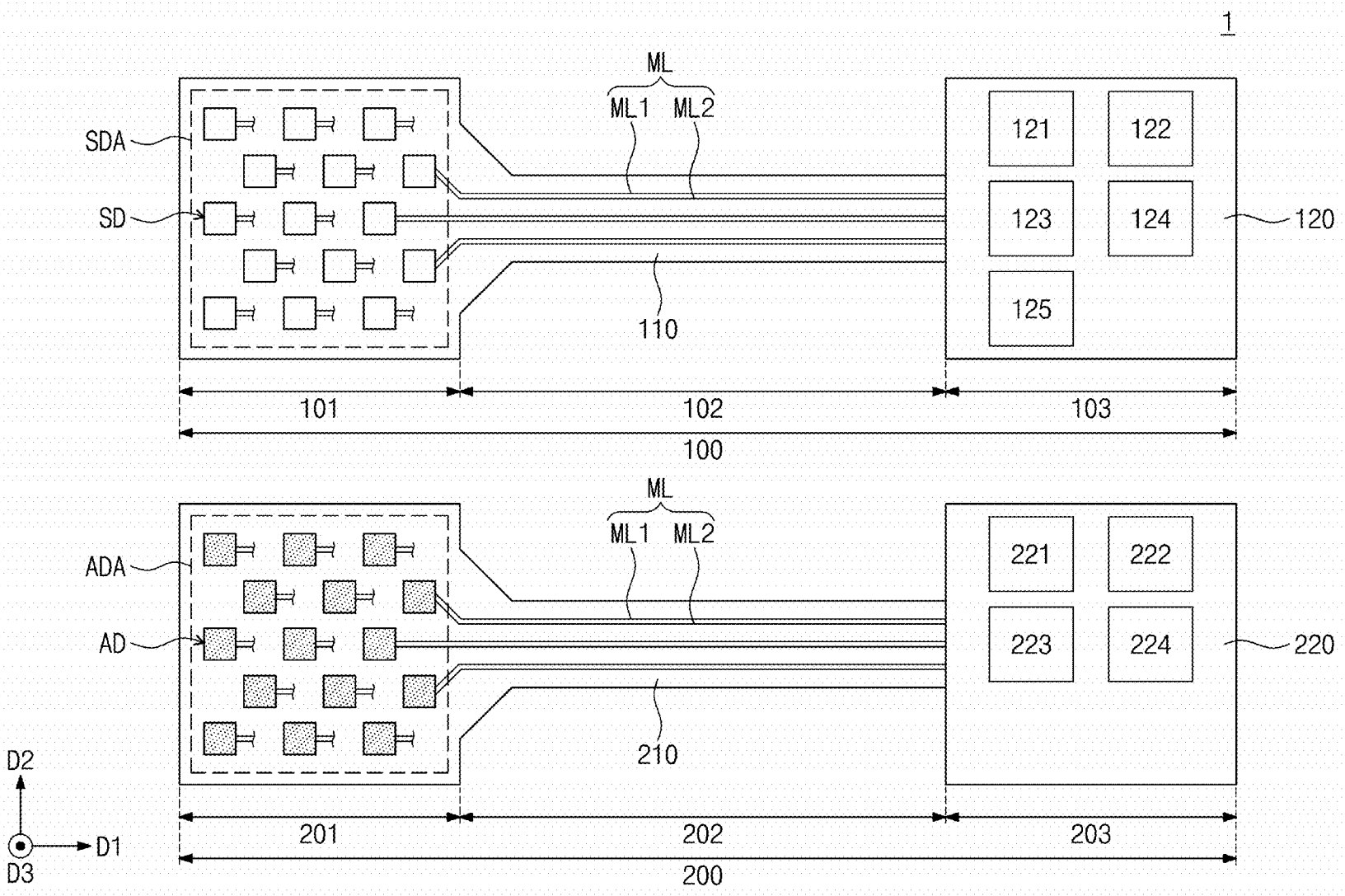
FIG. 1 is a conceptual diagram illustrating a telehaptic device according to an embodiment of the inventive concept.

FIG. 1 is a conceptual diagram illustrating a telehaptic device according to an embodiment of the inventive concept.

Referring to FIG. 1, the telehaptic device 1 may include a piezoelectric sensor module 100 and a piezoelectric actuator module 200. The piezoelectric sensor module 100 and the piezoelectric actuator module 200 may be configured as separate and independent devices.

The piezoelectric sensor module 100 may include a sensing unit 101, a first signal processing unit 103, and a first connection part 102 connecting them.

The sensing unit 101 and the first connection part 102 may include a first flexible substrate 110. The first flexible substrate 110 may be, for example, a flexible printed circuit board (F-PCB). As another example, the first flexible substrate 110 may include a polyimide-based substrate having a thickness of at least 4 micrometers. The first signal processing unit 103 may include a first support substrate 120, the first support substrate 120 may include a printed circuit board (PCB), and the flexibility of the first flexible substrate 110 may be greater than that of the first supporting substrate 120. According to some embodiments, the first supporting substrate 120 may be an F-PCB, and the first flexible substrate 110 and the first supporting substrate 120 may share a single unified substrate.

A piezoelectric sensor array SDA may be provided on the sensing unit 101. The piezoelectric sensor array SDA may include a plurality of piezoelectric sensors SD. A plurality of metal wires ML may be provided on the first connection part 102. The metal wires ML may include first signal wires ML1 and second signal wires ML2. The first signal wire ML1 may be connected to the first electrode EL1 of the piezoelectric sensor SD, as will be described later. The second signal wire ML2 may be connected to the second electrode EL2 of the piezoelectric sensor SD (refer to FIG. 2B).

A first driving circuit 121, a first amplifier circuit 122, a transmitter 123, a first power circuit 124, and a signal filter circuit 125 may be included on the first signal processing unit 103. The transmitter 123 may also be referred to as a first wireless communication circuit 123. The first driving circuit 121 may be electrically connected to each of the piezoelectric sensors SD through the metal wires ML.

The first driving circuit 121 may convert tactile information (e.g., pressure intensity, change, etc.) sensed by the piezoelectric sensors SD into a first electrical signal. The first amplifier circuit 122 may increase the amplitude of the first electrical signal. The signal filter circuit 125 may remove noise of the first electrical signal. The transmitter 123 may transmit the first electrical signal to the receiver 223. The first power circuit 124 may supply power to the first driving circuit 121, the first amplifier circuit 122, the transmitter 123, and the signal filter circuit 125.

The piezoelectric actuator module 200 may include a vibration unit 201, a second signal processing unit 203, and a second connection part 202 connecting them.

The vibration unit 201 and the second connection part 202 may include a second flexible substrate 210. The second flexible substrate 210 may be, for example, an F-PCB. As another example, the second flexible substrate 210 may include a polyimide-based substrate having a thickness of at least 4 micrometers. The second signal processing unit 203 may include a second support substrate 220, the second support substrate 220 may include, for example, a PCB, and the flexibility of the second flexible substrate 210 may be greater than that of the second support substrate 220. According to some embodiments, the second supporting substrate 220 may be an F-PCB, and the second flexible substrate 210 and the second supporting substrate 220 may share a single unified substrate.

A piezoelectric actuator array ADA may be provided on the vibration unit 201. The piezoelectric actuator array ADA may include a plurality of piezoelectric actuators AD.

A plurality of metal wires ML may be provided on the second connection part 202. The metal wires ML may include a first signal wire ML1 and a second signal wire ML2. The first signal wire ML1 may be connected to the first electrode EL1 of the piezoelectric actuator AD, as will be described later. The second signal wire ML2 may be connected to the second electrode EL2 of the piezoelectric actuator AD (refer to FIG. 2B).

A second driving circuit 221, a second amplifier circuit 222, a receiver 223, and a second power circuit 224 may be included on the second signal processing unit 203. The receiver 223 may also be referred to as a second wireless communication circuit 223.

After receiving the first electrical signal, the receiver 223 may transmit the first electrical signal to the second driving circuit 221. The second driving circuit 221 may generate a second electrical signal corresponding to the first electrical signal. The second driving circuit 221 may be electrically connected to each of the piezoelectric actuators AD through metal wires ML. The second driving circuit 221 may apply a second electrical signal to the piezoelectric actuator AD. The second amplifier circuit 222 may increase the amplitude of the second electrical signal. The second power circuit 224 may supply power to the second driving circuit 221, the second amplifier circuit 222, and the receiver 223.

Figure 2A:
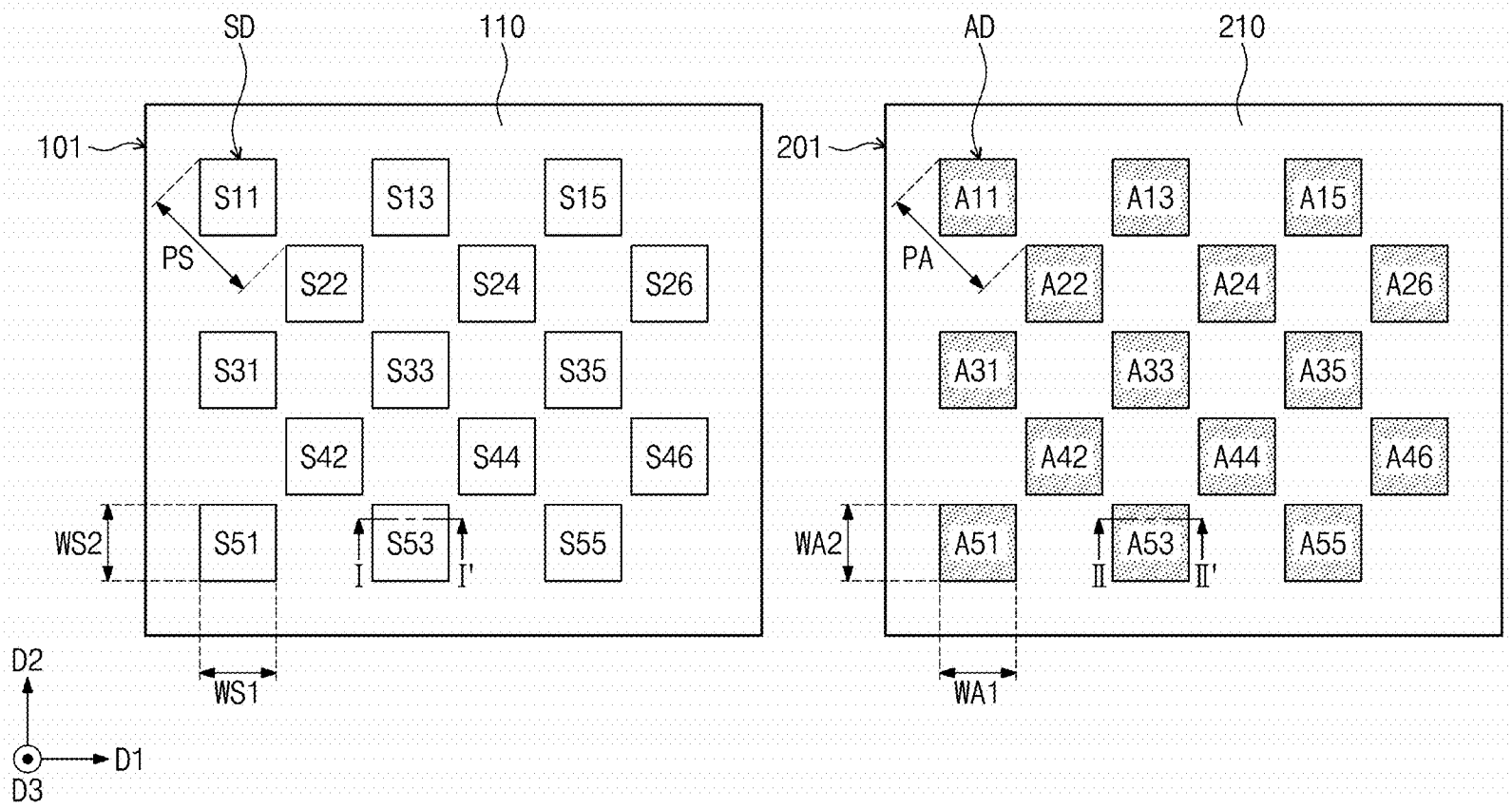
FIG. 2A is an enlarged view of a sensing unit and a vibration unit of FIG. 1.
Figure 2B:
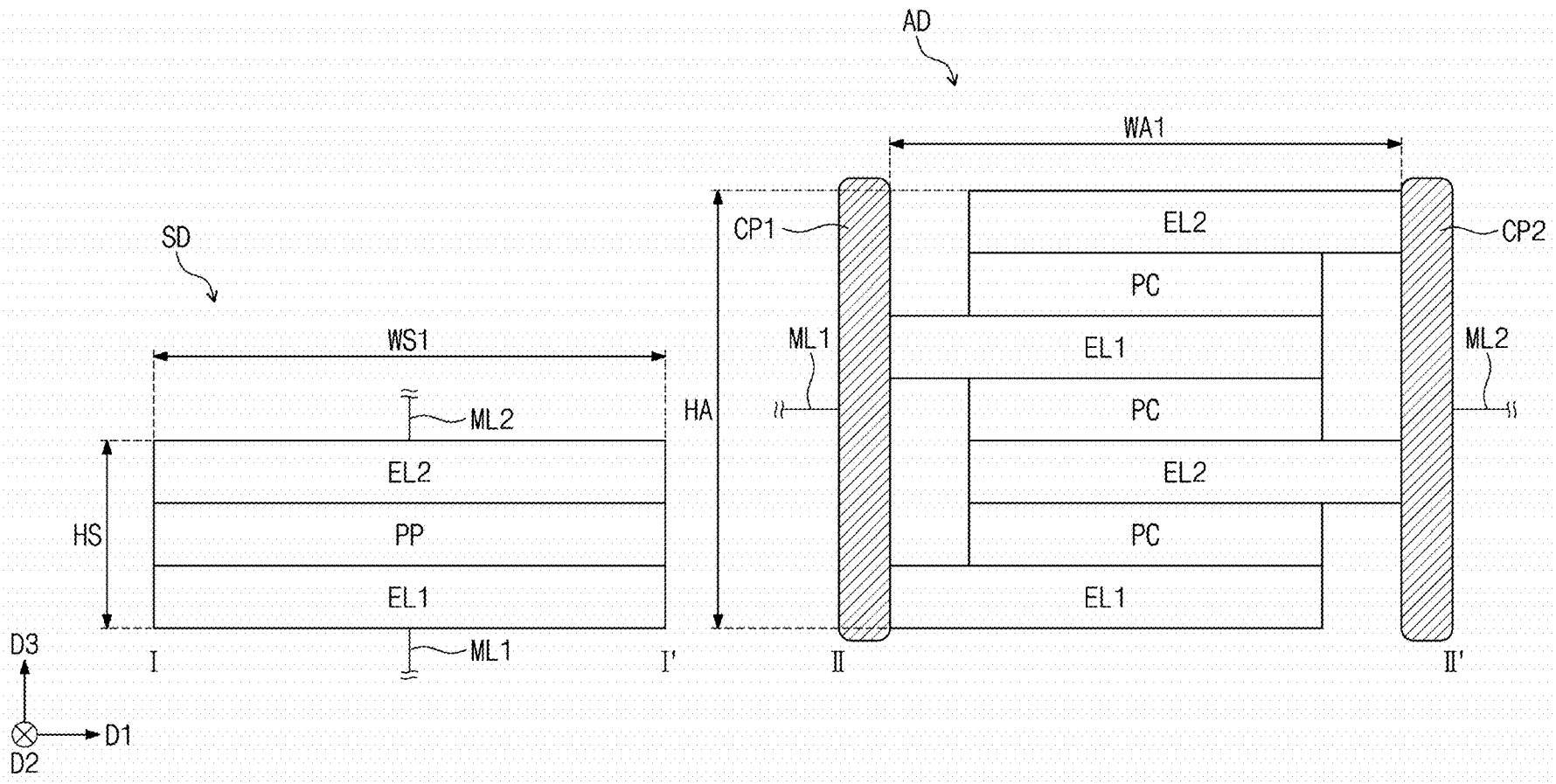
FIG. 2B is a diagram schematically illustrating a cross-section taken along I-I' and a cross-section taken along II-II' of FIG. 2A.

FIG. 2A is an enlarged view of the sensing unit 101 and the vibration unit 201 of FIG. 1. FIG. 2B is a diagram schematically illustrating a cross-section taken along I-I' and a cross-section taken along II-II' of FIG. 2A. In order to show the composition more clearly, the first signal wires ML1 and the second signal wires ML2 connected to the piezoelectric sensors SD and the piezoelectric actuators AD of FIG. 1 are omitted from FIG. 2.

Referring to FIG. 2A, the piezoelectric sensors SD may be spaced apart along a first direction D1 parallel to the upper surface of the first flexible substrate 110, and a second direction D2 parallel to the upper surface of the first flexible substrate 110 and intersecting the first direction D1.

As an example, the piezoelectric sensors SD may be arranged in a zigzag form in alignment with 5 rows and 6 columns as shown in the drawing. As they are arranged in a zigzag form, a total of 15 piezoelectric sensors SD of (5×6)/2 may be arranged. As another example, a total of 32 piezoelectric sensors SD of (8×8)/2 may be arranged in a zigzag form according to 8 rows and 8 columns. The above-described number of rows, number of columns, and zigzag arrangement are merely arbitrary, and the number of rows, number of columns, and arrangement may be variously designed.

The piezoelectric sensors SD may be arranged according to a first pitch PS along a diagonal direction. The diagonal direction refers to a direction forming an angle greater than 0° and less than 90° with the first direction D1 and the second direction D2. When the planar shape of the piezoelectric sensors SD is square or close to a square, the diagonal direction means a direction forming an angle close to 45° or 45° with the first direction D1 and the second direction D2.

In the present specification, the pitch refers to the shortest distance between adjacent piezoelectric elements (piezoelectric sensors, piezoelectric actuators, etc.) and the width of the piezoelectric elements in the direction of each of the shortest distances. As shown in FIG. 2A, when the piezoelectric sensors SD are arranged in a zigzag manner, the first pitch PS means the sum of the diagonal length of the upper surface of the piezoelectric sensor SD and the separation distance in the diagonal direction in a plan view. The first pitch PS may be greater than 0.5 mm and less than or equal to 2 mm.

The piezoelectric actuators AD may be arranged along the first direction D1 and the second direction D2. The arrangement form and total number of piezoelectric actuators AD may be the same as the arrangement form and number of piezoelectric sensors SD. As shown in FIG. 2A, fifteen piezoelectric actuators AD may be arranged in a zigzag form to fit five rows and six columns.

The piezoelectric actuators AD may be arranged along a diagonal direction and according to a second pitch PA. The second pitch PA may be substantially the same as the first pitch PS.

Referring to FIGS. 2A and 2B, each of the piezoelectric sensors SD1 may have a first width WS1 in a first direction D1, and a second width WS2 in a second direction D2. Each of the piezoelectric actuators AD may have a third width WA1 in the first direction D1 and a fourth width WA2 in the second direction D2. The first width WS1 may be substantially equal to the third width WA1, and the second width WS2 may be substantially equal to the fourth width WA2.

The piezoelectric sensor SD may include a first electrode EL1, a second electrode EL2, and a piezoelectric polymer layer PL interposed therebetween. The piezoelectric polymer layer PL may include, for example, at least one of poly vinylidene fluoride (PVDF) and poly vinylidene fluoride-tetrafluoroethylene ((P)(VDF-TrFE)).

A first signal wire ML1 and a second signal wire ML2 may be connected to each of the electrodes EL1 and EL2 of the piezoelectric sensors SD, respectively.

The piezoelectric actuator AD may include a first electrode EL1, a second electrode EL2, and a piezoelectric ceramic layer PC interposed therebetween. The piezoelectric ceramic layer PC may include, for example, PZT($PbZr_xTi_{(1-x)}O_3$). A plurality of piezoelectric ceramic layers PC may be stacked, and a first electrode EL1 and a second electrode EL2 may be alternately interposed therebetween. The second electrode EL2 may protrude further in the first direction D1 than the piezoelectric ceramic layer PC, and the first electrode EL1 may protrude further in a direction opposite to the first direction D1 than the piezoelectric ceramic layer PC. Each of the protruding portions of the first electrodes EL1 may be covered by the first common conductive pattern CP1, and each of the protruding portions of the second electrodes EL2 may be covered by the second common conductive pattern CP2. A first signal wire ML1 and a second signal wire ML2 may be connected to the first common conductive pattern CP1 and the second common conductive pattern CP2, respectively.

The piezoelectric sensor SD may have a first height HS, and the piezoelectric actuator AD may have a second height HA. The second height HA may be greater than the first height HS.

As an example, the piezoelectric sensor SD may have a first width WS1, a second width WS2, and a first height HS of 1 mm, 1 mm, and 3 μm, respectively, and the piezoelectric actuator AD may have a third width WA1, a fourth width WA2, and a second height HA of 1 mm, 1 mm, and 0.8 mm, respectively. As described above, by implementing a piezoelectric sensor and a piezoelectric actuator in an ultra-small size and arranging a plurality of them according to a fine pitch, it is possible to implement and reproduce tactile information with high resolution.

Figure 3:
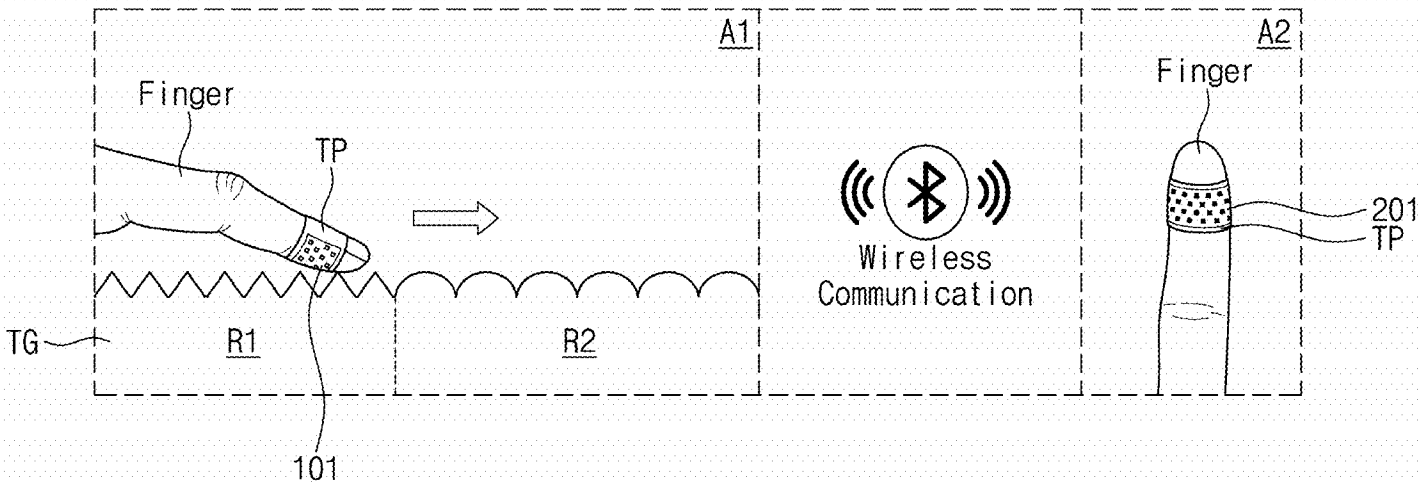
FIG. 3 is a conceptual diagram illustrating the operation of a telehaptic device according to the inventive concept.

FIG. 3 is a conceptual diagram illustrating the operation of a telehaptic device according to the inventive concept.

Referring to FIG. 3, a first user may be located in a first area A1, and a second user may be located in a second area A2. The location of the first area A1 and the location of the second area A2 for the telehaptic device 1 to operate depend on the type of wireless communication, and for example, in the case of using short-range wireless communication such as Bluetooth, the telehaptic device 1 may operate at a distance of less than 25 m.

The first user may attach the piezoelectric sensor module 100 to a body (e.g., hand). The sensing unit 101 may be wound on the tip of a finger through an adhesive tape TP. Although not shown in the drawing, the first signal processing unit 130 may be provided on the back of the hand or other parts of the body, and the first connection part 102 may connect the sensing unit 101 and the first signal processing unit 130.

A second user may also attach the piezoelectric actuator module 200 to a body (e.g., hand). The vibration unit 201 may be wound on the tip of a finger through an adhesive tape TP. Although not shown in the drawing, the second signal processing unit 230 may be provided on the back of the hand or other part of the body, and the second connection part 202 may connect the vibration unit 201 and the second signal processing unit 230.

The sensing unit 101 may contact the surface of the first region R1 of the target TG and may move to the surface of the second region R2 of the target TG in the direction of the arrow. The roughness of the first region R1 of the target TG and the roughness of the second region R2 of the target TG may be different. That is, tactile information sensed by the first user in the first region R1 of the target TG and tactile information sensed in the second region R2 of the target TG may be different.

For example, when the sensing unit 101 sequentially contacts the first region R1 and the second region R2 with a constant force and a constant speed in the direction of the arrow, and the piezoelectric sensors SD may generate a first electrical signal in the first region R1 and generate a second electrical signal in the second region R2. The amplitude and frequency of the first electrical signal and the second electrical signal may be different.

While the sensing unit 101 moves while contacting the surface of the first region R1 of the target TG, the second signal processing unit 203 may receive the first electrical signal through wireless communication in real time or after a time delay. The first electrical signal vibrates the piezoelectric actuator AD, so that the second user may feel the roughness of the surface of the first region R1 of the target TG through the vibration unit 201 without contacting the surface of the first region R1 of the target TG. Also, when the second electrical signal is received, the roughness of the surface of the second region R2 of the target TG may be felt without contacting the surface of the second region R2 of the target TG.

Figure 4:
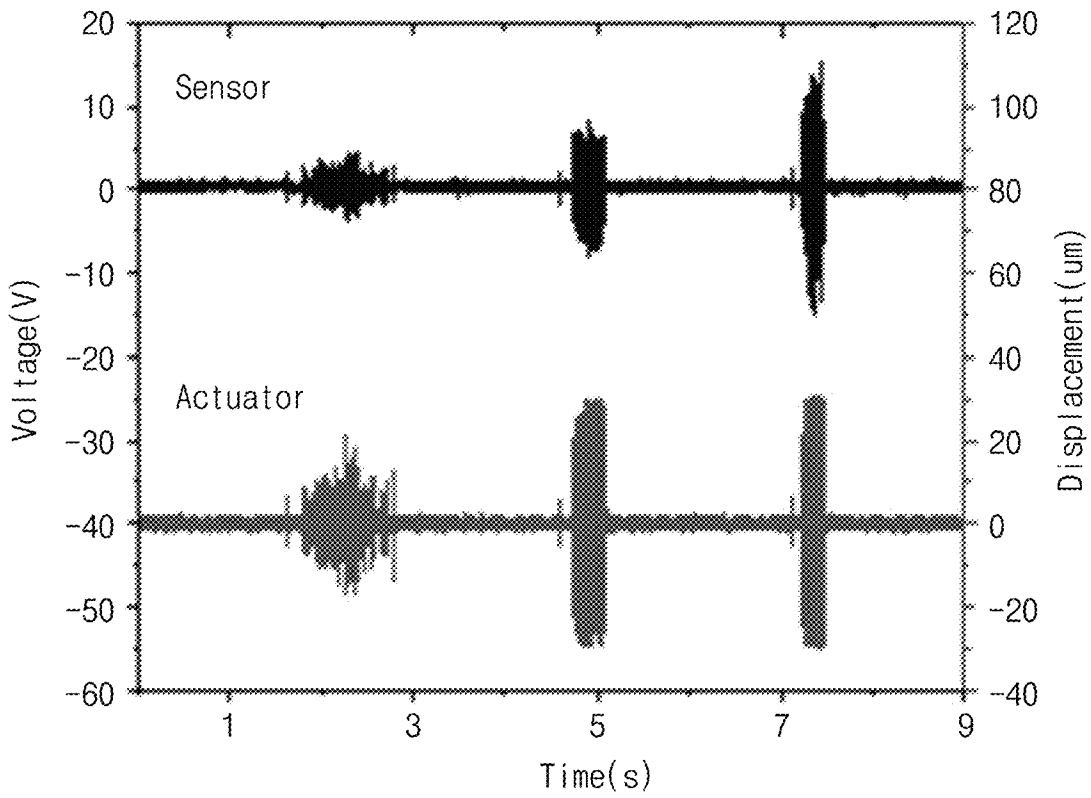
FIG. 4 is a graph illustrating a correspondence between an electrical signal sensed by a piezoelectric sensor and an electrical signal applied to a piezoelectric actuator.

FIG. 4 is a graph illustrating a correspondence between an electrical signal sensed by a piezoelectric sensor and an electrical signal applied to a piezoelectric actuator.

Referring to FIG. 4, it may be seen that the electrical signal sensed by the piezoelectric sensor corresponds to the electrical signal applied to the piezoelectric actuator. Specifically, it may be seen that the electrical signal sensed by the piezoelectric sensor is transmitted in real time and applied to the piezoelectric actuator. In addition, it may be seen that the frequency of the electrical signal detected by the piezoelectric sensor is the same as the frequency of the electrical signal applied to the piezoelectric actuator.

Figure 5:
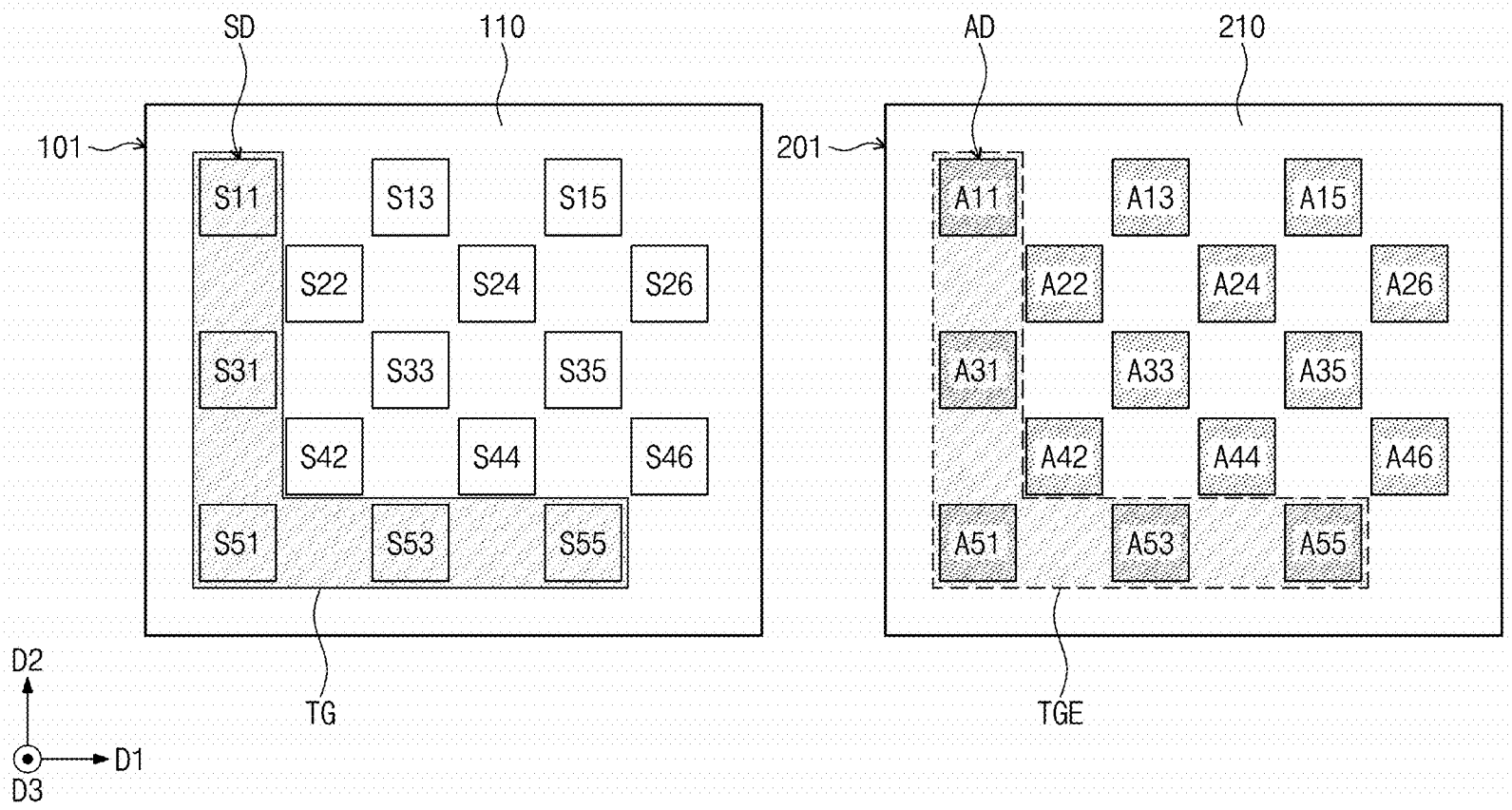
FIG. 5 is a conceptual diagram illustrating acquisition of tactile information by the sensing unit of FIG. 2A and reproduction of tactile information by the vibration unit of FIG. 2A.

FIG. 5 is a conceptual diagram illustrating acquisition of tactile information by the sensing unit of FIG. 2A and reproduction of tactile information by the vibration unit of FIG. 2A.

As described above, the arrangement and number of piezoelectric actuators AD may be the same as the arrangement and number of piezoelectric sensors SD.

In the piezoelectric actuator array ADA, piezoelectric actuators positioned in certain rows and columns may correspond to piezoelectric sensors positioned in the rows and columns in the piezoelectric sensor array SDA. For example, tactile information recognized by the piezoelectric sensor S11 disposed in the first row and first column may be implemented through the piezoelectric actuator A11 disposed in the first row and first column.

As shown in FIG. 5, for example, a target TG having an "L" shape may be mounted on the sensing unit 101.

A pressure may be applied to some of the piezoelectric sensors S11, S31, S51, S53, and S55 (hereinafter referred to as contact piezoelectric sensors) in contact with the target TG.

The contact piezoelectric sensors S11, S31, S51, S53, and S55 may sense the intensity of pressure over time applied to each, and generate respective electrical signals. Each of the electrical signals may be transmitted to the receiver 214 of the piezoelectric actuator module 200 through the first driving circuit 111 and the transmitter 114 of FIG. 1.

The receiver 214 and the second driving circuit 211 may transmit respective electrical signals to each of the piezoelectric actuators AD corresponding to each of the piezoelectric sensors SD. Each of the corresponding piezoelectric actuators A11, A31, A51, A53, and A55 corresponding to the contact piezoelectric sensors S11, S31, S51, S53 and S55 may vibrate according to each applied electrical signal.

As another example, a first pressure may be applied to the first contact piezoelectric sensor S11, and a second pressure may be applied to the second contact piezoelectric sensor S51, and the first pressure may be greater than the second pressure. The first pressure may be constantly applied to the first contact piezoelectric sensor S11 according to the first period, and the second pressure may be constantly applied according to the second period, and the first period may be greater than the second period.

Accordingly, the first electrical signal generated by the first contact piezoelectric sensor S11 may be different from the second electrical signal generated by the second contact piezoelectric sensor S51. Specifically, the first electrical signal may have a smaller amplitude and a larger frequency than the second electrical signal.

The first electrical signal and the second electrical signal may be simultaneously received by the receiver 214 through wireless communication. Through the receiver 214 and the second driving circuit 211, the first electrical signal may be a third electrical signal, and the second electrical signal may be a fourth electrical signal.

The first corresponding piezoelectric actuator A11 corresponding to the first contact piezoelectric sensor S11 may vibrate by receiving the third electrical signal, and the second corresponding piezoelectric actuator A51 corresponding to the second contact piezoelectric sensor S51 may vibrate by receiving the fourth electrical signal. The third electrical signal may have the same frequency as the first electrical signal, and the fourth electrical signal may have the same frequency as the second electrical signal. Accordingly, the frequency of the third electrical signal may be smaller than the frequency of the fourth electrical signal. The amplitude of the third electrical signal may be greater than the amplitude of the fourth electrical signal.

Through the high-resolution actuator array of the same structure as the piezoelectric sensor array, the telehaptic device according to the inventive concept may transmit the tactile information to each piezoelectric actuator by 1:1 matching and reproduce the tactile information sensed by each piezoelectric sensor in real time.

According to some embodiments, tactile information sensed by each piezoelectric sensor may be transmitted to each piezoelectric actuator and reproduced in real time by N:1 matching or 1:N matching. For example, the first contact piezoelectric sensor S11 may be patterned more finely and provided in plurality (N). The plurality of first contact piezoelectric sensors S11 may match the first corresponding piezoelectric actuator A11 by N:1, and FIG. 6 is an enlarged view of a piezoelectric sensor array and a piezoelectric actuator array according to some embodiments.

Figure 6:
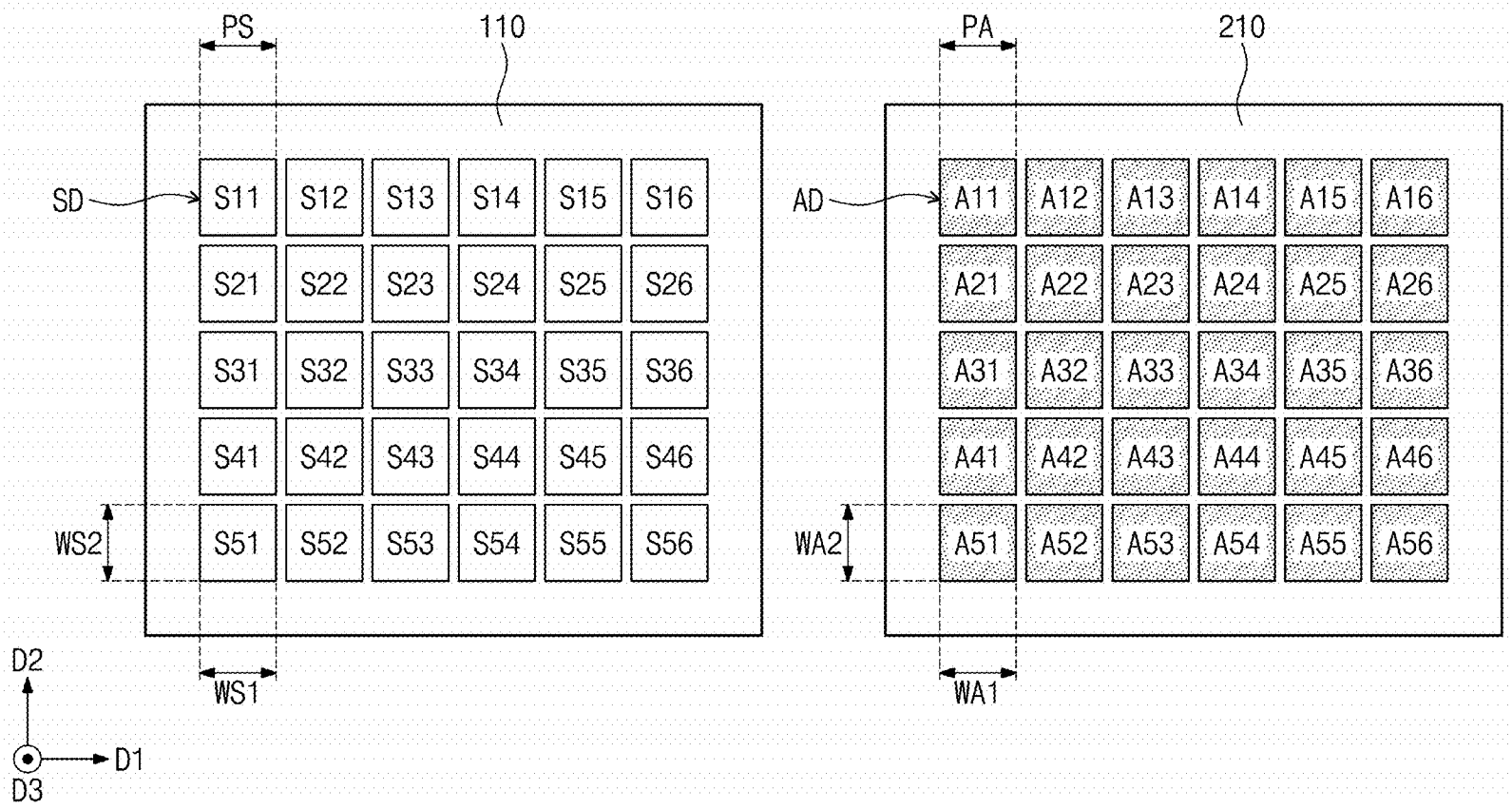
FIG. 6 is an enlarged view of a sensing unit and a vibration unit according to some embodiments.

Referring to FIG. 6, the piezoelectric sensors SD may be sequentially arranged according to rows and columns. For example, the piezoelectric sensors SD may be arranged along six rows and five columns, and a total of 30 piezoelectric elements may be arranged. The piezoelectric sensors SD may be arranged according to the first pitch PS, and the first pitch PS may be the sum of the first width W1 along the first direction D1 of the piezoelectric sensor SD and the separation distance along the first direction D1 between the adjacent piezoelectric sensors SD. The piezoelectric actuators AD may be arranged to have the same arrangement shape and number as the piezoelectric sensors SD. The piezoelectric actuators AD may be arranged according to the second pitch PA, and the second pitch PA may be substantially equal to the first pitch PS.

Figure 7A:
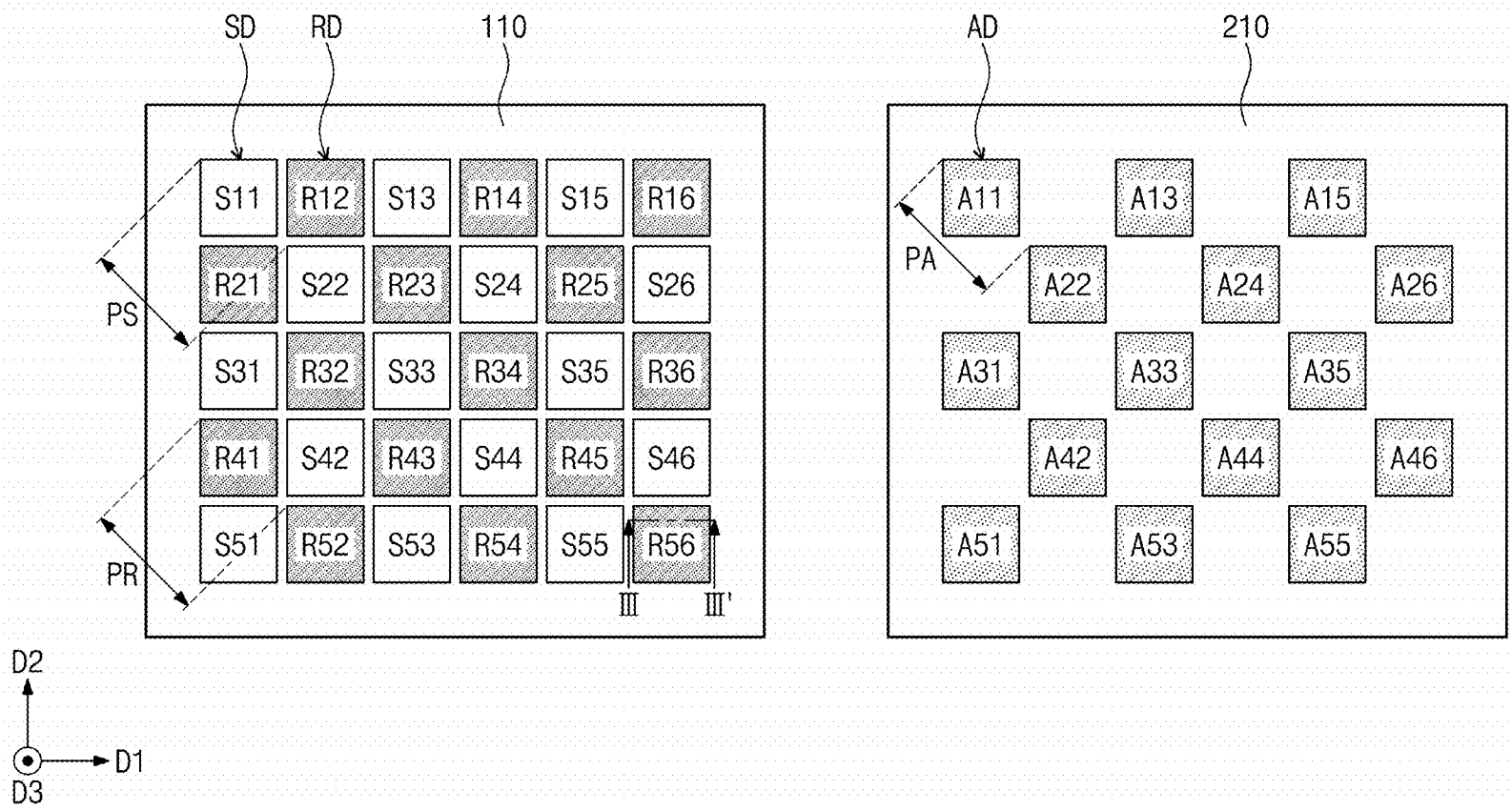
FIG. 7A is an enlarged view of a sensing unit and a vibration unit according to some embodiments.
Figure 7B:
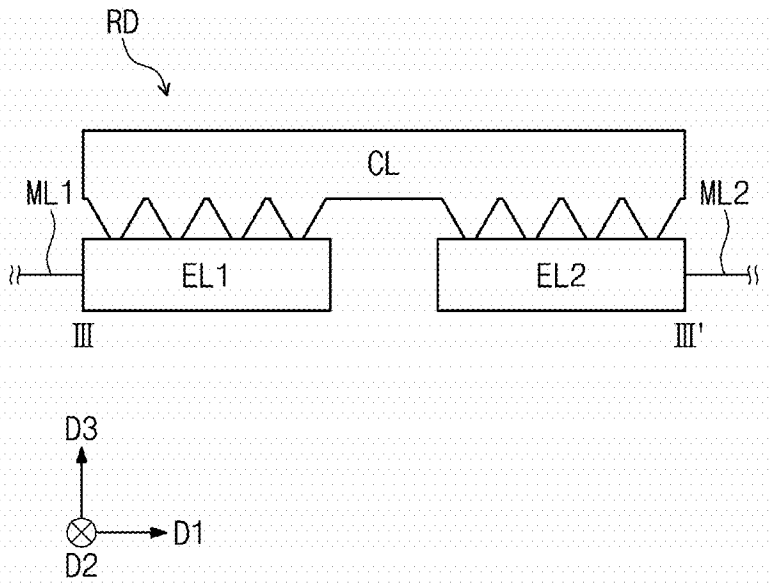
FIG. 7B is a view schematically showing a cross-section taken along III-III' of FIG. 7A.

FIG. 7A is an enlarged view of a piezoelectric sensor array and a piezoelectric actuator array according to some embodiments. FIG. 7B is a view schematically showing a cross-section taken along of FIG. 7A.

Referring to FIG. 7A, the sensing unit 101 may further include a piezo-resistive sensor array. The piezo-resistive sensor array may include a plurality of piezo-resistive sensors RD.

The piezoelectric sensors SD may be arranged in a zigzag, and the piezoelectric sensors SD may be arranged with skipping one row along the first direction D1. The piezoelectric sensors SD may be disposed along the second direction D2 while skipping one row. In this way, piezo-resistive sensors RD may be disposed in spaces where piezoelectric sensors SD are not disposed. For example, the piezo-resistive sensors RD may be arranged along six rows and five columns, and may be arranged in a zigzag manner. The piezo-resistive sensors RD may be arranged according to the third pitch PR, and the third pitch PR may be substantially the same as the first pitch PS. The width along the first direction D1 and the width along the second direction D2 of each of the piezo-resistive sensors RD may be substantially equal to the first width W1 and the second width W2 of the piezoelectric sensors SD, respectively.

Referring to FIG. 7B, the piezo-resistive sensor RD may include a first electrode EL1, a second electrode EL2, and a conductive structure CL. The first electrode EL1 and the second electrode EL2 may be spaced apart from each other in the first direction D1. A conductive structure CL having a curved contact surface may be provided on the first electrode EL1 and the second electrode EL2. When pressure is applied on the conductive structure CL, the area of the contact surface may change, and the resistance of the conductive structure CL may change. The resistance of the piezo-resistive sensor RD may vary according to the strength of the pressure.

The piezoelectric sensor SD may be a dynamic pressure sensor, and the piezo-resistive sensor RD may be defined as a static pressure sensor. That is, the piezoelectric sensor SD and the piezo-resistive sensor RD measure the pressure respectively, but the piezoelectric sensor SD has strength in measuring the frequency when the pressure changes, and the piezo-resistive sensor RD has strength in measuring the amplitude of the pressure of a constant intensity.

A piezo-resistive sensor RD may form a set with an adjacent piezoelectric sensor SD to transmit tactile information. For example, the piezo-resistive sensor R12 positioned in the first row and the second column may constitute a set with the piezoelectric sensor S11 positioned in the first row and the first column. One piezoelectric sensor S11 and an adjacent piezo-resistive sensor R12 transmit tactile information to the corresponding piezoelectric actuator A11 to reproduce the tactile information.

The telehaptic device according to the inventive concept implements a piezoelectric sensor and a piezoelectric actuator in an ultra-small size and arranges a plurality of them according to a fine pitch, so that it is possible to implement and reproduce tactile information with high resolution.

In relation to the telehaptic device according to the inventive concept, through the high-resolution actuator array of the same structure as the piezoelectric sensor array, the telehaptic device according to the inventive concept may transmit the tactile information to each piezoelectric actuator by 1:1, 1:N, or N:1 matching and reproduce the tactile information sensed by each piezoelectric sensor in real time.

Although the embodiments of the inventive concept have been described, it is understood that the inventive concept should not be limited to these embodiments but various changes and modifications may be made by one ordinary skilled in the art within the spirit and scope of the inventive concept as hereinafter claimed.

What is claimed is:

1. A telehaptic device comprising a piezoelectric sensor module and a piezoelectric actuator module that are separated and spaced apart from each other, wherein the piezoelectric sensor module comprises:

a first flexible substrate;

a first support substrate connected to the first flexible substrate;

a piezoelectric sensor array on the first flexible substrate; and a first wireless communication circuit on the first support substrate, wherein the piezoelectric actuator module comprises:

a second flexible substrate;

a second support substrate connected to the second flexible substrate;

a piezoelectric actuator array on the second flexible substrate; and a second wireless communication circuit on the second support substrate, wherein the piezoelectric sensor array comprises a plurality of piezoelectric sensors, the piezoelectric sensors being arranged to be spaced apart according to a first pitch, wherein the piezoelectric actuator array comprises a plurality of piezoelectric actuators, the piezoelectric actuators being arranged to be spaced apart according to a second pitch, wherein the first flexible substrate comprises a first region in which the piezoelectric sensor array is provided and a second region connecting the first region and the first support substrate, wherein the second flexible substrate comprises a third region in which the piezoelectric actuator array is provided and a fourth region connecting the third region and the second support substrate, and wherein first metal wires are further provided in the second region and second metal wires are further provided in the fourth region.

2. The telehaptic device of claim 1, wherein the number of piezoelectric sensors is equal to the number of piezoelectric actuators.

3. The telehaptic device of claim 1, wherein the first pitch and the second pitch are greater than 0.5 mm and within 2 mm.

4. The telehaptic device of claim 1, wherein each of the piezoelectric sensors comprises a first electrode, a second electrode and a piezoelectric polymer layer therebetween, wherein each of the piezoelectric actuators comprises a third electrode, a fourth electrode and a piezoelectric ceramic layer therebetween.

5. The telehaptic device of claim 1, wherein the first pitch and the second pitch are substantially the same.

6. The telehaptic device of claim 1, wherein the first metal wires comprise first signal wires and second signal wires, wherein each of the first signal wires is electrically connected to a first electrode, wherein each of the second signal wires is electrically connected to a second electrode, wherein the second metal wires comprise third signal wires and fourth signal wires, wherein each of the third signal wires is electrically connected to a third electrode, wherein each of the fourth signal wires is electrically connected to a fourth electrode.

7. The telehaptic device of claim 1, wherein an arrangement form of the piezoelectric sensors and an arrangement form of the piezoelectric actuators are the same.

8. The telehaptic device of claim 7, wherein the piezoelectric sensors and the piezoelectric actuators are arranged in a zigzag form along a first direction parallel to the first flexible substrate.

9. The telehaptic device of claim 8, wherein the piezoelectric sensor module further comprises a piezo-resistive sensor array provided on the first flexible substrate, wherein the piezo-resistive sensor array comprises a plurality of piezo-resistive sensors, wherein the piezo-resistive sensors are provided between the piezoelectric sensors, respectively.

10. The telehaptic device of claim 9, wherein each of the piezo-resistive sensors comprises:

a first electrode and a second electrode spaced apart along the first direction; and a conductive structure provided on the first electrode and the second electrode, a resistance of which varies according to pressure.

11. A telehaptic device comprising a piezoelectric sensor module configured to be worn by a first user and a piezoelectric actuator module configured to be worn by a second user, wherein the piezoelectric sensor module comprises:

a first substrate; and a piezoelectric sensor array, a first driving circuit, first metal wires, and a transmitter on the first substrate, wherein the piezoelectric actuator module comprises:

a second substrate; and a piezoelectric actuator array, a second drive circuit, second metal wires, and a receiver on the second substrate, wherein the piezoelectric sensor array comprises a first piezoelectric sensor and a second piezoelectric sensor, wherein the piezoelectric actuator array comprises a first piezoelectric actuator and a second piezoelectric actuator, wherein the first piezoelectric sensor is configured to sense a first pressure and generate a first electrical signal, wherein the second piezoelectric sensor is configured to sense a second pressure and generate a second electrical signal, wherein the transmitter is configured to deliver first and second electrical signals to the receiver, wherein the second driving circuit is configured to generate a third electrical signal corresponding to the first electrical signal, and to generate a fourth electrical signal corresponding to the second electrical signal, wherein the first piezoelectric actuator is configured to generate a first vibration corresponding to the first pressure based on the third electrical signal, wherein the second piezoelectric actuator is configured to generate a second vibration corresponding to the second pressure based on the fourth electrical signal, wherein each of the piezoelectric sensors comprises a first electrode, a second electrode and a piezoelectric polymer layer therebetween, wherein each of the piezoelectric actuators comprises a third electrode, a fourth electrode and a piezoelectric ceramic layer therebetween, wherein the first metal wires comprise first signal wires and second signal wires, wherein each of the first signal wires is electrically connected to the first electrode, wherein each of the second signal wires is electrically connected to the second electrode, wherein the second metal wires comprise third signal wires and fourth signal wires, wherein each of the third signal wires is electrically connected to the third electrode, and wherein each of the fourth signal wires is electrically connected to the fourth electrode.

12. The telehaptic device of claim 11, wherein a frequency of the first electrical signal is the same as a frequency of the third electrical signal, wherein a frequency of the second electrical signal is the same as a frequency of the fourth electrical signal.

13. The telehaptic device of claim 11, wherein an amplitude of the first electrical signal is greater than an amplitude of the second electrical signal, wherein an amplitude of the third electrical signal is greater than an amplitude of the fourth electrical signal.

* * * * *